United States Patent [19]

Maehara et al.

[11] Patent Number: 4,721,600

[45] Date of Patent: Jan. 26, 1988

[54] SUPERPLASTIC FERROUS DUPLEX-PHASE ALLOY AND A HOT WORKING METHOD THEREFOR

[75] Inventors: Yasuhiro Maehara, Kobe; Yoshio Tarutani, Nishinomiya, both of Japan

[73] Assignee: Sumitomo Metal Industries, Ltd., Osaka, Japan

[21] Appl. No.: 844,661

[22] Filed: Mar. 27, 1986

[30] Foreign Application Priority Data

Mar. 28, 1985 [JP] Japan ..... 60-064163
Apr. 19, 1985 [JP] Japan ..... 60-084087

[51] Int. Cl.[4] ..... C22C 38/02; C22C 38/04

[52] U.S. Cl. ..... 420/57; 420/59; 420/73; 420/74; 420/108; 420/109; 420/117; 420/584; 148/325; 148/327; 148/329; 148/332; 148/334; 148/335

[58] Field of Search ..... 420/56, 57, 59, 72, 420/73, 74, 109, 117, 108, 902, 584; 148/325, 327, 329, 332, 334, 335

[56] References Cited

U.S. PATENT DOCUMENTS 3,736,131 5/1973 Espy ..... 420/59
4,055,448 10/1977 Fujikura et al. ..... 148/325

FOREIGN PATENT DOCUMENTS 138012 4/1985 European Pat. Off. .
136997 4/1985 European Pat. Off. .
1533158 1/1970 Fed. Rep. of Germany ..... 420/56
60-262946 12/1985 Japan ..... 420/73
1248980 10/1971 United Kingdom .
2133037 7/1984 United Kingdom .
2136017 9/1984 United Kingdom .

OTHER PUBLICATIONS

U.K. Search Report for Application No. 8607770.

*Primary Examiner*—L. Dewayne Rutledge
*Assistant Examiner*—Deborah Yee
*Attorney, Agent, or Firm*—Burns, Doane, Swecker & Mathis

[57] ABSTRACT

A superplastic hot working method for a duplex-phase, nitrogen-containing ferrous alloy and stainless steel, and a superplastic duplex-phase ferrous alloy are disclosed. The ferrous alloy comprises: at least one of Si and Mn in an amount of not less than 0.5% and not less than 1.7%, respectively; and N: at least 0.01% in solid solution, wherein Si eq and Mn eq which are defined as:

$$\text{Si eq} = \text{Si} + (\tfrac{2}{3})(\text{Cr} + \text{Mo}), \text{ and Mn eq} = \text{Mn} + 2\,\text{Ni} + 60\,\text{C} + 50\,\text{N},$$

satisfy the formula:

$$(5/6)(\text{Si eq}) - 15/2 \leqq \text{Mn eq} \leqq (11/5)(\text{Si eq}) - 77/5,$$

and its superplastic hot working is carried out by deforming the alloy heated to 700°-1200° C. at a strain rate of $1\times10^{-6}\,S^{-1}$ to $1\times10^{0}\,S^{-1}$. In another aspect, superplastic hot working of a duplex-phase stainless steel comprising Cr: 10.0-35.0%, Ni: 2.0-18.0%, Mo: 0-6.0%, and N: 0.005-0.3% and having the values of Si eq and Mn eq as above is carried out by deforming the steel at a strain rate of from $1\times10^{-6}\,S^{-1}$ to $1\times10^{1}\,S^{-1}$ after heating to a temperature of at least 700° C. and at most 100° C. below the temperature at which the steel transforms into a single ferrite phase, preferably in a non-oxidizing nitrogen atmosphere.

10 Claims, 2 Drawing Figures

SUPERPLASTIC FERROUS DUPLEX-PHASE ALLOY AND A HOT WORKING METHOD THEREFOR

BACKGROUND OF THE INVENTION

This invention generally relates to a superplastic duplex-phase ferrous alloy suitable for superplastic working and to a superplastic hot working method therefor. More particularly, it relates to an inexpensive nitrogen-containing ferrous duplex-phase alloy for superplastic working which exhibits two phases consisting of a ferrite phase and an austenite phase at temperatures near 1000° C., and a superplastic hot working method therefor. This invention also relates to a superplastic hot working method for a duplex-phase stainless steel which exhibits two phases consisting of a ferrite phase and an austenite phase near room temperature and which has Fe, Cr, and Ni as main components.

It is known that duplex-phase ferrous alloys including duplex-phase stainless steels which consist of a ferrite phase ($\alpha$) and an austenite phase ($\gamma$) generally have excellent strength, toughness, and weldability. For this reason, in recent years, they have come to be used in a wide variety of fields, and the demand therefor has been increasing. However, the presence of these two phases also causes these steels to be difficult to work.

Accordingly, in order to improve the workability of this type of duplex-phase ferrous alloy, in the past, countermeasures have been taken such as reducing the amount of impurities such as sulfur (S) and oxygen (0) which are harmful to hot working. At present, it has become possible to perform hot working of such ferrous alloy in the manufacture of simple shapes such as pipes and plates and forgings having relatively simple shapes. However, the manufacture of parts with complicated shapes such as pipe joints and valves from a duplex-phase ferrous alloy by hot working alone is still extremely difficult, and it is necessary to rely on machining and molding processes which have a poor yield or efficiency.

In recent years, much research has been performed on superplastic working technology as a method of forming such difficult to work materials into complicated shapes. It has been reported that a duplex-phase ferrous alloy, such as duplex-phase stainless steel which contains large quantities of Cr, Mo, and Ni and which is difficult to work by the conventional hot working exhibits remarkable superplasticity [see "Iron and Steel", Japanese version, 70, (1984) pp. 378–385]. The superplastic working method reported therein employs a superplastic phenomenon accompanying the precipitation of the $\sigma$-phase in a duplex-phase stainless steel having a composition of Si: $<0.48\%$, Mn: $<1.60\%$, Ni: 5.5–7%, Cr: 21–25%, Mo: 2.7–2.8%, and N: at most 0.15%. As a result of such research, the common idea up to the present time that it is difficult to utilize superplasticity with duplex-phase ferrous alloy has been disproven, and the technology related to its superplastic working is constantly developing. In addition to the previously-described mechanical properties and weldability, this type of duplex-phase stainless steel exhibits excellent corrosion resistance, and products manufactured from such duplex-phase stainless steel by superplastic working are highly suitable, for example, for use in sea water such as for seawater-resisting instruments and parts for drilling oil wells, although the superplastic working has to be carried out at a relatively low strain rate with heating.

However, this type of duplex-phase stainless steel contains relatively large amounts of Cr, Ni, and Mo, making it expensive. Therefore, there is a limit to its uses, and there is a strong desire for the development of an inexpensive material having excellent superplasticity which is a general ferrous alloy and which can be used in products not requiring excellent corrosion resistance.

When performing superplastic working on the above-described duplex-phase stainless steel which contains relatively large amounts of Cr, Ni, and Mo, it is generally necessary that the strain rate during working be low in order to attain superplasticity. Therefore, not only does superplastic working require a relatively long time, but it is necessary to perform working while heating in order to prevent a decrease in temperature during working, both of which decrease manufacturing efficiency and increase costs.

SUMMARY OF THE INVENTION

Accordingly, an object of the present invention is to provide a less expensive superplastic material and a superplastic working method therefor.

Another object of the present invention is to provide an inexpensive duplex-phase ferrous alloy which is suitable for superplastic working and which can be successfully manufactured into a product having a desired shape including a complicated shape.

A further object of the present invention is to provide a novel and superior hot working method by which a desired shape can be imparted to a duplex-phase stainless steel using superplasticity.

A still further object of the present invention is to provide a method of working a duplex-phase stainless steel employing superplasticity whereby large deformations which are normally thought to be impossible are achievable at a sufficiently high strain rate.

A further object is to provide a hot working method employing a sufficiently high strain rate which makes it possible to manufacture articles having complicated shapes which can not be manufactured by presently-used superplastic working methods and which can be used to manufacture without the use of machining processes even articles which conventionally have been manufactured by machining processes so as to achieve increases in material yield and reductions in cost.

As a result of various investigations, the present inventors have found that if a duplex-phase structure consisting of a ferrite phase and an austenite phase can be obtained at temperatures near 1000° C. at which superplastic deformation is effected, even if the expensive elements Cr, Ni, and Mo are not contained at all or in large amounts, and even if precipitation of $\sigma$-phase is not employed, satisfactory superplastic working can be achieved.

More specifically, it has been found that, during the superplastic deformation of an $(\alpha+\gamma)$ duplex-phase material of the type described above, the relatively hard $\gamma$-phase undergoes breakage and fine dispersion and becomes spherical, and the recrystallization during deformation of the relatively soft $\alpha$-phase plays an important role in the superplastic deformation. As a result, compared with a single-phase alloy, attaining superplasticity is remarkably easy in a duplex-phase material, e.g., of $(\alpha+\gamma)$ structure. Such an $(\alpha+\gamma)$ duplex-phase can be formed near 1000° C. with an inexpensive ferrous alloy when it has the values of Si eq and Mn eq defined below adjusted within a particular range and contains at least 0.01% N in solid solution. Therefore, superplastic working can be achieved without employing an expensive duplex-phase stainless steel.

Particularly, it has been found that the presence of N in solid solution in a ferrous alloy is critical in order to ensure superior superplastic deformability of the material. The reason for this is not get fully understood, but it is thought that N acts to accelerate transformation of $\alpha$-phase into an $(\alpha+\gamma)$ or $(\alpha+\gamma+\sigma)$ multi-phase structure which facilitates superplastic deformation.

The present inventors also carried out research on superplasticity of $(\alpha+\gamma)$ or $(\gamma+\sigma)$ duplex-phase stainless steel and found that by selecting a particular steel composition and heating temperature, superior superplasticity can be attained with such stainless steel at a high strain rate. It has also been found that when superplastic working of such duplex-phase stainless steel is carried out in a nitrogen atmosphere, particularly in the case of thin materials, the elongation at breakage remarkably increases in a high-temperature tensile test. Such high-temperature elongation is a good indication of the limit to superplastic working, i.e., the superplastic workability of the materials. Thus, in the case of duplex-phase stainless steel in which the N content is usually not so high, it is advantageous that superplastic working be performed in a nitrogen atmosphere in order to avoid denitrification in the surface region of the material and facilitate superplastic deformation during working by the above-described favorable effect of N.

In one aspect, the present invention provides a superplastic ferrous alloy which exhibits an $(\alpha+\gamma)$ duplex-phase structure and superplasticity at temperatures in the range of 700°-1200° C., and which consists essentially of, by weight, at least one of Si and Mn in an amount of not less than 0.5% and not less than 1.7%, respectively,

| | |
|---|---|
| N: at least 0.01% in solid solution, | |
| Ni: 0-5.0%, | Cr: 0-20.0%, |
| Mo: 0-6.0%, | Cu: 0-1.0%, |
| Ti: 0-0.5%, | Zr: 0-0.5%, |
| Nb: 0-0.5%, | V: 0-0.5%, and |
| W: 0-1.0%, | |

the balance being Fe and incidental impurities, wherein Si eq and Mn eq which are defined as $$\text{Si eq}=\text{Si}+(2/3)(\text{Cr}+\text{Mo}),$$

and $$\text{Mn eq}=\text{Mn}+2\ \text{Ni}+60\text{C}+50\text{N}$$

satisfy the formula $$(5/6)(\text{Si eq})-15/2\leqq\text{Mn eq}\leqq(11/5)(\text{Si eq})-77/5.$$

According to another aspect, the present invention provides a superplastic hot working method for a ferrous alloy as defined above, which comprises deforming the alloy heated to 700°-1200° C. at a strain rate of from $1\times10^{-6}\ S^{-1}$ to $1\times10^{0}\ S^{-1}$.

According to the present invention, Si and Mn eq are regulated by the above formula so that under the hot working temperatures of 700°-1200° C., the ratio $\gamma/(\alpha+\gamma)$ in the ferrous alloy is in the range of 0.2-0.8 so as to ensure the occurrence of the desired $(\alpha+\gamma)$ duplex-phase structure and to facilitate superplastic deformation of the alloy. As long as the conditions defined by the above formula are satisfied, regardless of the exact composition of the alloy, the requirement that $\gamma/(\alpha+\gamma)=0.2-0.8$ is met in the alloy at temperatures of 700°-1200° C., and superior superplasticity is attained. Preferably, the values of Si eq and Mn eq are as follows:

$$1.1(\text{Si eq})-10.8\leqq\text{Mn eq}\leqq1.7(\text{Si eq})-14,\ \text{and Si eq}=\text{from 14 to 26.}$$

In a still another aspect, the present invention provides a superplastic hot working method for a duplex-phase stainless steel which consists essentially of, by weight,

| | |
|---|---|
| C: at most 0.05%, | Si: 0-5.0%, |
| Mn: 0-20.0%, | P: at most 0.05%, |
| S: at most 0.02%, | Cr: 10.0-35.0%, |
| Ni: 2.0-18.0%, | Mo: 0-6.0%, |
| N: 0.005-0.3%, and | |
| one or more of W: 0-5.0%, Zr: 0-3.0%, Nb: 0-3.0%, V: 0-5.0%, and Cu: 0-1.0%, | |

the balance being Fe and incidental impurities, wherein Si eq and Mn eq which are defined above satisfy the formula $$(5/6)(\text{Si eq})-15/2\leqq\text{Mn eq}\leqq(11/5)(\text{Si eq})-77/5,$$

the method comprising deforming the steel at a strain rate of from $1\times10^{-6}\ S^{-1}$ to $1\times10^{1}\ S^{-1}$ with the steel heated to a temperature of at least 700° C. and at most 100° C. below the temperature at which the steel transforms into a single ferrite phase, preferably in a non-oxidizing nitrogen atmosphere.

In a preferred embodiment, the composition of the duplex-phase stainless steel is as follows, by weight:

| | |
|---|---|
| C: at most 0.03%, | Si: 0.05-5.0%, |
| Mn: 0.05-20.0%, | P: at most 0.04%, |
| S: at most 0.01%, | Cr: 15.0-30.0%, |
| Ni: 3.0-10.0%, | Mo: 0.5-4.0%, |
| N: 0.01-0.25%, and | |
| optionally one or more of W: 0.01-5.0%, Zr: 0.01-3.0%, Nb: 0.01-3.0%, V: 0.01-5.0%, and Cu: 0.01-1.0%, | |

the balance being Fe and incidental impurities.

The term "non-oxidizing nitrogen gas atmosphere" used herein includes not only substantially pure nitrogen gas atmospheres, but also those nitrogen gas atmospheres which contain less than 50% by volume of one or more other non-oxidizing gases such as argon, hydrogen, and helium. Thus, the atmosphere may be $N_2$, $N_2+Ar$, $N_2+H_2$, and $N_2+He$, provided that a major part thereof is nitrogen. In some instances it may contain a slight amount of $O_2$.

DETAILED DESCRIPTION OF THE PREFERRED EMBODIMENTS

Figure 2:
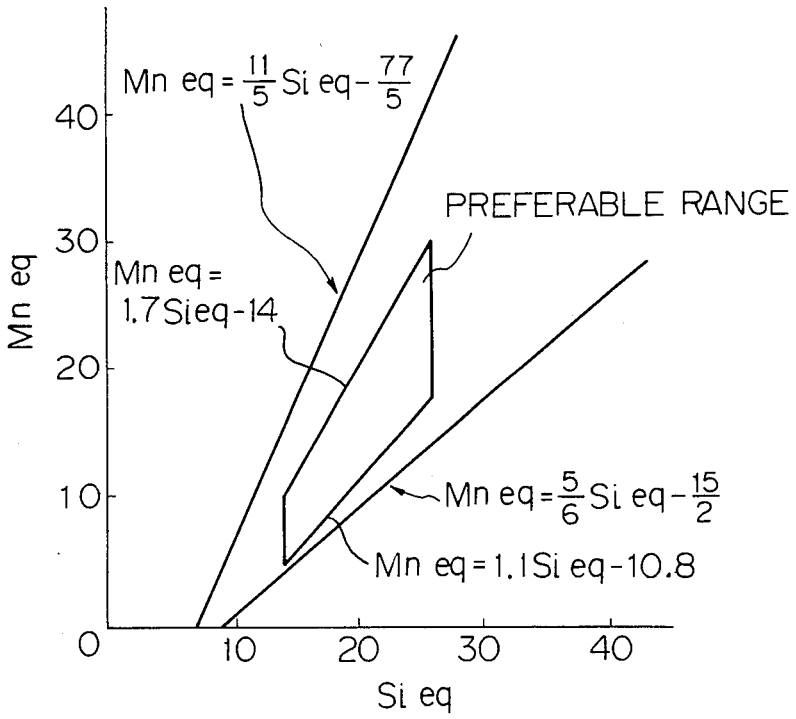
FIG. 2 is a graph showing the range of Si eq and Mn eq defined by the present invention with a preferable range thereof.

The term "duplex-phase" used herein indicates that the alloy or steel exhibits a duplex-phase structure at least at the high temperatures at which the material is subjected to superplastic working.

In the following description and examples, all the percentages are by weight unless otherwise indicated.

Next, the reasons for the above restrictions on the alloy composition and superplastic working conditions according to the present invention will be explained.

Composition of Duplex-Phase Ferrous Alloy:

In one aspect, the present invention provides an inexpensive superplastic duplex-phase ferrous alloy containing relatively large amounts of Si and/or Mn, and N in solid solution, in which Si eq and Mn eq satisfy the above formula, and which is capable of exhibiting the desired $(\alpha+\gamma)$ duplex-phase structure at 700°-1200° C. so that it can be subjected to superplastic deformation at such temperatures.

Specifically, the superplastic duplex-phase ferrous alloy consists essentially of: at least one of Si and Mn in an amount of not less than 0.5% and not less than 1.7%, respectively,

| | |
|---|---|
| N: at least 0.01% in solid solution, | |
| Ni: 0-5.0%, | Cr: 0-20.0%, |
| Mo: 0-6.0%, | Cu: 0-1.0%, |
| Ti: 0-0.5%, | Zr: 0-0.5%, |
| Nb: 0-0.5%, | V: 0-0.5%, and |
| W: 0-1.0%, | |

the balance being Fe and incidental impurities, wherein Si eq and Mn eq which are defined as $$\text{Si eq}=\text{Si}+(\tfrac{6}{5})(\text{Cr}+\text{Mo}),$$

and $$\text{Mn eq}=\text{Mn}+2\text{Ni}+60\text{C}+50\text{N}$$

satisfy the following formula (1).

$$(5/6)(\text{Si eq})-15/2\leqq\text{Mn eq}\leqq(11/5)(\text{Si eq})-77/5 \quad (1)$$

Preferably, the ferrous alloy consists essentially of:

| | |
|---|---|
| Si: 0.1-20.0%, | Mn: 0.1-30.0%, |
| N: 0.05-0.25% in solid solution, | |
| Ni: 0.05-4.0%, | Cr: 5.0-15.0%, |
| Mo: 0.05-4.0%, | Cu: 0-0.6%, |
| Ti: 0-0.3%, | Zr: 0-0.3%, |
| Nb: 0-0.3%, | V: 0-0.3%, and |
| W: 0-0.6%, | |

the balance being Fe and incidental impurities, wherein at least one of Si and Mn is in an amount of not less than 0.5% for Si and not less than 1.7% for Mh, and Si eq and Mn eq which are defined above satisfy the above formula (1), and more preferably satisfy the following formulas (2) and (3).

$$1.1(\text{Si eq})-10.8\leqq(\text{Mn eq})\leqq1.7(\text{Si eq})-14 \quad (2)$$

$$\text{Si eq}=\text{from 14 to 26} \quad (3)$$

The Si eq and Mn eq are defined in the present invention in order to evaluate an Si-converted equivalent amount of ferrite-forming elements and an Mn-converted equivalent amount of austenite-forming elements, respectively, and to control the alloy structure by means of the values of these equivalent amounts. In the superplastic ferrous alloy of the present invention, in order to ensure that the duplex-phase structure be formed at the hot working temperatures, Si eq and Mn eq are restricted to the range defined by the above formula (1). Thus, when Si eq and Mn eq are within the range, a duplex-phase structure consisting of $\alpha$-phase and $\gamma$-phase is formed and the ratio $\gamma/(\alpha+\gamma)$ becomes between 0.2 and 0.8 during hot working of the alloy, and superior superplasticity is attained.

More particularly, the range of Si eq and Mn eq defined by formula (1) and the preferable range defined by formulas (2) and (3) are shown in FIG. 2 which will be described later on. In the preferable range of Si eq and Mn eq indicated in FIG. 2, the ratio of $\alpha$-phase to $\gamma$-phase during superplastic deformation is close to 1:1. This ratio is desirable from the standpoint of ensuring improved properties of the product.

The reason for the conditions that one or both of at least 0.5% of silicon (Si) and at least 1.7% of manganese (Mn) be present in the ferrous alloy is that one of the objects of the present invention is to provide an inexpensive duplex-phase ferrous alloy composition which is suitable for use in superplastic working to manufacture products with fairly good corrosion resistance but not requiring extremely excellent corrosion resistance, and therefore the present invention attempts to actively employ Si or Mn as a ferrite-or austenite-forming element to obtain an $(\alpha+\gamma)$ duplex-phase structure. Therefore, in the ferrous alloy of the present invention, a greater amount of Si or Mn is added than was conventionally used as a deoxidizing agent.

In the present invention, there is no particular upper limit on Si and Mn, but in the case where the balance is substantially Fe (i.e., in an Fe-Si-Mn ternary alloy), adjustment of the structure to obtain the desired duplex-phase structure is easier when Si is less than 20.0% and Mn is less than 30.0%. The amounts of Si and Mn are preferably 0.1-20.0%, more preferably 0.5-15.0% for Si, and 0.1-30.0%, more preferably 1.5-20.0% for Mn.

As carbon (C) forms carbides and worsens the properties of the product, it is preferable that the ferrous alloy have as low a C content as possible. Preferably the C content as an impurity is at most 0.05%, and more preferably at most 0.04%.

Nitrogen (N) is a powerful $\gamma$-phase forming element, and it is easy to disperse compared with Mn and Ni. Accordingly, the presence of a substantial amount of N particularly in the surface region aids the previously-described change or transformation in structure into the desired duplex phase through a heat activation process. Moreover since N is one of the least expensive elements, addition of as large an amount of N as possible is advantageous. This is a unique feature of the alloy composition of the present invention. At least 0.01% N should be present in solid solution. Preferably 0.05%-0.25% of N is present in the alloy.

In contrast with duplex-phase stainless steels, in the ferrous alloy of the invention, the amounts of nickel (Ni), chromium (Cr), or molybdenum (Mo) which may optionally be added are not critical because the desired duplex-phase can be attained by Si, Mn, and N and the alloy does not always require good corrosion resistance. Usually they are limited to the following ranges for reasons of economy: Ni: 0-5.0%, preferably 0.05-4.0%, and more preferably 1.0-4.0%; Cr: 0-20.0%, preferably 5.0-15.0%, and more preferably 10.0-15.0%; and Mo: 0-6.0%, preferably 0.05-4.0%, and more preferably 1.0-4.0%. If it is desired to ensure that the ferrous alloy have good corrosion resistance, the amounts of Ni, Cr and Mo can be increased according to necessity.

In addition to Fe, Si, Mn, Ni, Cr, Mo, N, and C, if necessary, a duplex-phase ferrous alloy of the present invention may optionally contain at least one of at most 1.0% copper (Cu), at most 0.5% titanium (Ti), at most 0.5% zirconium (Zr), at most 0.5% niobium (Nb), at most 0.5% vanadium (V), and at most 1.0% tungsten (W). Preferably, the amounts of these optional elements are at most 0.6% Cu, at most 0.3% Ti, at most 0.3% Zr, at most 0.3% Nb, at most 0.3% V, and at most 0.6% W. In addition, the present invention includes the case where the ferrous alloy further contains small amounts of one or more of Re, Ca, and Ce, and incidental impurities.

Ti, Zr, Nb, and V easily form nitrides and reduce the amount of N in solid solution which is effective for facilitating superplasticity, and therefore if possible it is better not to add them.

However, as described above, in the present invention, as long as an $(\alpha+\gamma)$-type duplex-phase structure is formed at the hot working temperature, superior superplasticity can be attained regardless of the exact alloy composition, and it has been confirmed that even if one or more of the above optional elements is added, the $(\alpha+\gamma)$-type duplex-phase structure undergoes essentially no alternation.

Superplastic Working of Duplex-Phase Ferrous Alloy:

Before a ferrous alloy having the above-described composition is subjected to superplastic working, the as-prepared material which is usually in the form of a steel ingot or slab obtained through the ingot making or continuous casting process normally undergo preliminary working such as hot forging or hot rolling to obtain blanks, such as plates, rods, pipes, or other shapes, suitable for being subjected to superplastic working. Of course, such special methods as powder metallurgy methods, spray casting methods, or methods involving quench-solidification are included in the preliminary working methods to manufacture blanks. Preferably, after the preliminary hot working, the blank is water quenched, or subjected again to solution treatment at a temperature of at least 1000° C., and then, if necessary, lightly worked at a temperature of at most 700° C., whereby a larger superplastic effect is obtained. These procedures are also included in the preliminary working.

The superplastic deformation temperature range of the ferrous alloy is restricted to 700°–1200° C. because in this range, the above-described change in structure, i.e., transformation into an $(\alpha+\gamma)$ duplex-phase structure takes place and satisfactory superplasticity is attained. At temperatures below 700° C., this transformation via a heat activation process does not proceed sufficiently. On the other hand, if the temperature is above 1200° C., the ratio $\alpha/\gamma$ deviates far from the desired ratio of 1/1, or the $\gamma$-phase may even vanish, and superplasticity is difficult to obtain.

The strain rate during deformation is made from $10^{-6}$ to $10^{0}$ $S^{1}$ because when it is outside of this range, superplasticity due to the above-described change in structure becomes difficult to obtain. The proper conditions for temperature and strain rate employed in superplastic working are related to one another. As preferable ranges, 800° C.–1100° C. and a strain rate ($\dot{\epsilon}$) of $10^{-3}-10^{-1}$ $S^{-1}$ are recommended.

During deformation, a third phase such as an intermetallic compound (e.g., a $\sigma$-phase) may precipitate. This type of hard phase promotes the dynamic recrystallization of the $\alpha$-phase or $\gamma$-phase which is the mother phase and it is advantageous in attaining superplasticity. In some cases, it is possible to actively utilize this phenomenon to promote superplastic deformation.

The superplastic working performed according to the present invention includes such techniques as forging, bulging, wire drawing, and extrusion, and it is intended to include all working techniques which are carried out under the above-described conditions for temperature and strain rate. Diffusion bonding employing superplasticity is also included.

In the present invention, post-treatment of a superplastically-worked product is not particularly necessary, but in some cases, pickling in order to remove scales or solution treatment in order to remove carbides or intermetallic compounds may be performed as necessary.

Articles obtained in this manner have a very refined structure due to superplastic working, and therefore they are superior to articles produced by conventional processes with regards to mechanical properties and corrosion resistance. For this reason, it is possible to apply the less expensive ferrous alloy of the present invention to applications in which expensive corrosion-resistant materials such as stainless steels were conventionally used.

Superplastic Working of Duplex-Phase Stainless Steel:

The present invention also provides a superplastic hot working method of a duplex-phase stainless steel which generally comprises relatively large amounts of Cr, Ni, and Mo, and a relatively small amount of N compared with the above-described duplex-phase ferrous alloy.

According to the present invention, superplastic deformation of such a duplex-phase stainless steel preferably takes place in a non-oxidizing nitrogen gas atmosphere in order to improve superplasticity of the steel, particularly when the nitrogen content of the stainless steel is relatively low. As described above, the non-oxidizing atmosphere may contain a minor amount of another non-oxidizing gas such as Ar, $H_2$ or He, or a mixture thereof, and a slight amount of $O_2$.

Although the exact mechanism of attaining improved superplasticity by hot working in such an atmosphere is not clearly known, it is thought to be as follows.

Namely, when superplastic deformation of a duplex-phase stainless steel is performed in vacuum or a nitrogen-free non-oxidizing atmosphere such as argon, hydrogen, helium, or a mixture thereof, denitrification of the surface of the material takes place and proceeds during superplastic deformation. If the nitrogen content of the steel is rather low, such denitrification decrease the nitrogen content to an extremely low level, thereby adversely affecting superplasticity of the steel. However, in a non-oxidizing atmosphere comprising primarily nitrogen, there is no such denitrification. Moreover, in the case of a duplex-phase stainless steel having a very small nitrogen amount, even nitrogen absorption from the nitrogen gas atmosphere takes place on the surface of the steel.

As previously described with respect to the ferrous alloy containing a relatively large amount of N, the presence of N in a steel material is effective to accelerate phase transformation in the material in which $\alpha$-phase becomes two or more phases of the $(\alpha+\sigma)$ or ($\alpha+\gamma+\sigma$)-type. For this reason, if denitrification does not occur in the surface region of the material, superplastic deformation more easily progresses in this region, and the superplastic working limit, i.e., the elongation at breakage is remarkably increased.

In general, it is thought that during superplastic working internal pores are produced in a material in the region undergoing superplastic working and extended, ultimately leading to breakage. However, from the findings of the present inventors, as described above, when superplastic working is performed in a vacuum or in an atmosphere consisting of Ar, $H_2$, or He gas, or a mixture thereof, denitrification occurring in the surface region is expected to cause a decrease in deformability accompanied by a decrease in the superplastic working limit of the material surface.

Therefore, substantial denitrification should be avoided in superplastic working of a duplex-phase stainless steel having a very low N content. However, when the duplex-phase stainles steel has a relatively high N content in the range defined below, superplastic working thereof may be successfully performed in a nitrogen-free or nitrogen-poor non-oxidizing atmosphere, or in vacuum, or in air.

Furthermore, even when superplastic working is performed in a nitrogen gas atmosphere, if the dew point of the nitrogen gas atmosphere is high, the oxidation of the surface of a material undergoing superplastic working may be severe, and in some instances, there was a tendency for the superplastic working limit to decrease. In order to avoid such decrease in superplastic working limit, the dew point of the atmosphere is preferably 0° C. or below.

The duplex-phase stainless steel to be hot worked according to the present invention comprises Cr: 10.0–35.0%, Ni: 2.0–18.0%, Mo: 0–6.0%, and N: 0.005–0.3%. If these elements are present in the above-listed proportions, there are no particular limits on the other components. However, usually, the duplex-phase stainless steel consists essentially of

| | |
|---|---|
| C: at most 0.05%, | Si: 0–5.0%, |
| Mn: 0–20.0%, | P: at most 0.05%, |
| S: at most 0.02%, | Cr: 10.0–35.0%, |
| Ni: 2.0–18.0%, | Mo: 0–6.0%, |
| N: 0.005–0.3%, and | |

optionally at least one of W, Zr, Cu, Nb, and V within the ranges given below, with the balance being Fe and incidental impurities.

| |
|---|
| W: 0–5.0%, Zr: 0–3.0%, Nb: 0–3.0%, V: 0–5.0%, and Cu: 0–1.0%. |

Also the values of Si eq and Mn eq which are defined above should satisfy the formula $$(5/6)(\text{Si eq})-15/2 \leqq \text{Mn eq} \leqq (11/5)(\text{Si eq})-77/5.$$

Preferably, the composition of the duplex-phase stainless steel is as follows:

| | |
|---|---|
| C: at most 0.03%, | Si: 0.05–5.0%, |
| Mn: 0.05–20.0%, | P: at most 0.04%, |
| S: at most 0.01%, | Cr: 15.0–30.0%, |
| Ni: 3.0–10.0%, | Mo: 1.0–4.0%, |
| N: 0.01–0.25%, and | |

-continued

| |
|---|
| optionally one or more of W: 0.01–5.0%, Zr: 0.01–3.0%, Nb: 0.01–3.0%, V: 0.01–5.0%, and Cu: 0.01–1.0%, |

the balance being Fe and incidental impurities.

Here, the reasons for the restriction on each of the elements of the duplex-phase stainless steel will be explained.

C: Carbon (C) forms chromium carbides and decreases the effective amount of chromium, and therefore it may adversely affect the corrosion resistance of steel. Accordingly, in the present stainless steel, the upper limit of C is 0.05%, and preferably it is at most 0.03%.

Si: Silicon (Si) is an effective deoxidizing element. In addition, it acts to increase the oxidation resistance at high temperatures. However, the presence of excessive Si tends to deteriorate the workability of steel. Therefore, in the present steel, the amount of Si is not greater than 5.0% and preferably 0.05–5.0%. Most usually, it is in the range of 0.1–3.0%.

Mn: Manganese (Mn) is an effective element for fixing the S in steel, and when present together with Si, it has a deoxidizing effect. In addition, Mn is an effective austenite-forming element like Ni and N, and it acts to increase the solubility of N in steel. In the present steel, the amount of Mn is not greater than 20.0% and preferably 0.05–20.0%. Most usually it is in the range of 0.1–5.0%.

P: Phosphorus (P) is an impurity, and its upper limit is set at 0.05%. Preferably the amount of P is at most 0.04%, and more preferably at most 0.03%.

S: Sulfur (S) is also an impurity, and it has the effect of decreasing corrosion resistance. The amount of S is preferably as small as possible. In a preferred embodiment, the upper limit of S is set at 0.02%, and more preferably, it is at most 0.01%.

Cr: Chromium (Cr) is a fundamental element for influencing corrosion resistance. The lower limit is set at 10.0%. Corrosion resistance is improved to the extent that the Cr content is increased, but on the other hand, it embrittles steel. The upper limit of Cr is set at 35.0%. Preferably, the Cr content is 15.0–30.0%, and more preferably 17.0–30.0%.

Ni: Nickel (Ni) ranks with Cr and Mo as an element which influences corrosion resistance, and at the same time it is an effective austenite-forming element. With a Cr content of 10.0–35.0%, it is necessary to have 2.0–18.0% Ni to obtain a duplex-phase structure. Preferably, the amount of Ni is 3.0–10.0%, and more preferably 4.0–10.0%.

Mo: Molybdenum (Mo) ranks with Cr and Ni as an element which influences corrosion resistance, and it is extremely effective at increasing corrosion resistance. For this purpose at least 0.01% is recommended, although it may not be added at all. The upper limit is 6.0% for reasons of economy. Preferably, the Mo content is 0.5–4.0%, and more preferably 1.0–4.0%.

N: Nitrogen (N) ranks with Ni and C as an extremely effective austenite-forming element, and it also has the effect of stabilizing the austenite structure particularly at high temperatures. For this reason the amount of N is set in the range of 0.005–0.3%. Preferably it is in the range of 0.01–0.25%, more preferably 0.02–0.25%, and most preferably 0.05–0.25%.

W: Tungsten (W) has the effect of improving corrosion resistance, and if necessary at least 0.01% is added.

The upper limit is 5.0%. A preferable range of W content is 0.1–0.7% when added.

Nb, Zr: Niobium (Nb) and zirconium (Zr) stabilize the C in steel, and if necessary, at least 0.01% of each is added. The upper limit for each is 3.0%. A preferable content of each is 0.1–0.3% when added.

V: Vanadium (V) improves corrosion resistance in the same manner as Cr, and it also acts to increase the solubility of N in steel. If necessary, V is added in an amount of at least 0.01% and at most 5.0%, and preferably in an amount of 0.1–1.0%.

Cu: Copper (Cu) acts to improve corrosion resistance. However, if added in large amounts, the steel becomes embrittled. If necessary at least 0.01% of Cu is added, while the upper limit is 1.0%. A preferable range of Cu content is 0.1–0.5%.

In addition, as elements in the form of impurities, there are cases in which at most 0.1% of Al as a deoxidizing element and small amounts of rare earth elements, Ca, Ce, Mg, and the like may be present in the steel.

Oxygen forms oxides in steel and it effects the formation of voids during superplastic working. Preferably, the oxygen content is restricted to at most 0.008%.

Preferably, in order that the proportions of ferrite and austenite (i.e., $\alpha$- and $\gamma$-phases be nearly equal near 1000° C. at which hot working is performed, the value of Cr eq is approximately 3 times that of Ni eq, wherein Cr eq and Ni eq are defined as follows:

$$Cr\ eq = Cr + Mo + 1.5Si,$$

$$Ni\ eq = Ni + 0.5Mn + 30C + 25N.$$

The reason for this is that not only is it important to make hot deformation favorable, but that it is also important from the standpoint of ensuring the desired properties of the product, and favorable results can be obtained by ensuring the above-described conditions for Cr eq and Ni eq.

As previously stated, if the weight proportions of $\alpha$-phase and $\gamma$-phase are approximately equal, with increasing amounts of the more easily dispersed elements C and N among the $\gamma$-phase-forming elements Ni, Mn, C, N, and the like, the dispersion and spheroidizing of the $\gamma$-phase during deformation are promoted, which has advantageous effects on superplastic deformation. For this reason, the presence of N in a relatively large amount of up to 0.3% may be employed. However, since C easily forms carbides which adversely affect the properties of products, the amount of carbon should be as small as possible. For this reason, as already stated, carbon is generally at most 0.05%.

The superplastic deformation of a duplex-phase stainless steel mainly occurs in a duplex-phase state consisting of $\alpha$-phase and $\gamma$-phase, and this superplasticity is realized through the breakage and spheroidizing of the relatively hard $\gamma$-phase and the dynamic recrystallization during deformation of the relatively soft $\alpha$-phase. In the method of the present invention, particularly when the steel has a very low N content, it is important to prevent denitrification or to promote nitrogen absorption in order to maintain a high level of N in the surface region of the steel being deformed.

Superplastic deformation of a duplex-phase stainless steel also occurs under conditions in which $\sigma$-phase precipitates during deformation in a low temperature range below 1000° C. In general, this takes place at a temperature of at least 700° C. In this case, a co-precipitation reaction occurs in which $\alpha$-phase transforms into $\gamma$-phase+$\sigma$-phase during deformation, and the reaction achieves a kind of transformation superplasticity effect so that the material gains ductility. Afterwards, the $\alpha$-phase disappears and a ($\gamma+\sigma$) duplex-phase state arises, whereupon dispersion and spheroidizing of the the relatively hard $\sigma$-phase in the relatively soft $\gamma$-phase take place. Deformation of the steel proceeds as the $\gamma$-phase undergoes dynamic recrystallization in the same manner as the $\alpha$-phase in the duplex phase consisting of ($\alpha+\gamma$). Again in the duplex-phase of ($\gamma+\sigma$)-type, a larger amount of the easy to disperse $\gamma$-forming element N has advantageous effects with respect to the recrystallization process of the $\gamma$-phase. In this manner, when trying to actively employ precipitation of $\sigma$-phase, the value of Cr eq is preferably at least 25, and Cr eq is approximately 3×Ni eq.

A duplex-phase stainless steel having a composition as defined above does not necessarily require a special pretreatment process prior to superplastic deformation, and therefore the steel is of high industrial value. Namely, the steel useful for superplastic working can be ingots or slabs obtained by the usual ingot making or continuous casting process, which are usually preformed into blanks such as plates, bars, pipes, or other shapes by hot forging or hot rolling. Such blanks may be used for superplastic working without further treatment. However, after preforming, the blanks are preferably water quenched or subjected again to solution treatment, and then, if necessary, subjected to light working in a low-temperature range of at most 700° C., in which case a greater superplasticity may be achieved.

The temperature range for deformation is at least 700° C. and at most 100° C. below the temperature at which transformation to a single $\alpha$-phase occurs because if the temperature is below 700° C., the action of the thermal activation process to cause the above-mentioned precipitation of $\gamma$-phase and recrystallization of $\alpha$-phase (or in some cases, precipitation of $\sigma$-phase and recrystallization of $\gamma$-phase) which are necessary for superplasticity is insufficient and superplasticity becomes difficult to obtain. On the other hand, if the above upper temperature limit is exceeded, the amount of $\gamma$-phase is greatly decreased, and the desired effect of promoting recrystallization of the $\alpha$-phase which is caused by dispersion and spheroidizing of the $\gamma$-phase as the second phase is not achieved sufficiently. Normally, transformation into a single $\alpha$-phase occurs at 1200°–1350° C. A preferable temperature range for superplastic deformation is 800°–1100° C.

The strain rate ($\dot{\varepsilon}$) during deformation is $10^{-6}$–$10^{1}$ $S^{-1}$ because if it is outside of this range, the above-described phase transformation does not readily occur during deformation, and superplasticity becomes difficult to obtain. In general, from the standpoint of practical use, the preferable range is $10^{-4}$–$10^{0}$ $S^{-1}$.

Although superplastic working of the duplex-phase stainless steel may be generally carried out in air or in any non-oxidizing atmosphere, it is preferable to use a nitrogen-rich non-oxidizing atmosphere, as mentioned previously. When the N content of the steel is very low in the above-defined range, an atmosphere composed substantially of $N_2$ is particularly satisfactory. Also as mentioned previously, the dew point of the atmosphere is preferably 0° C. or below, more preferably −10° C. or below, and most preferably −30° C. or below. By lowering the dew point, it is possible to prevent oxidation of the surface during superplastic working, and in the case when the material has a metallic luster prior to superplastic working, it is possible to maintain the metallic luster after working. Surface discoloration due to oxidation can be prevented by making the dew point −10° C. or below, and by making it −30° C. or below, metallic luster can be maintained after working.

The superplastic working of a stainless steel as defined above may be effected by forging, bulging, wire drawing, extrusion, and the like, and it is intended to include all working techniques carried out under the above conditions. Diffusion bonding employing superplasticity is also included.

Post-treatments are generally not necessary for stainless steel products produced by the present invention, but in some cases, it may be necessary to perform pickling to remove scales or solution treatment to transform the precipitated $\sigma$-phase.

Stainless steel articles obtained in this manner have a very refined structure due to superplastic working, and therefore they are superior with respect to mechanical properties and corrosion resistance to similar articles manufactured by conventional process.

Next, the present invention will be further illustrated by working examples. It should be understood that these are merely for the purpose of illustration and do not unduely restrict the present invention.

EXAMPLE 1

This example illustrates the use of inexpensive duplex-phase ferrous alloys based on a ternary system of Fe-Mn-Si. A series of ferrous alloys having the compositions shown in Table 1 below were prepared by a usual method, and after blooming, they were subjected to hot forging or hot rolling to obtain rods with a diameter of 20 mm, from which round tensile test bars were cut.

Each test bar underwent tensile deformation under the conditions shown in Table 2 below, the elongation as well as the maximum stress from the stress-strain curve were determined, and the relationship between superplastic strain and various factors was determined. Simultaneously, small test pieces were obtained, and after heating to 1000° C., they were water quenched and the ratio of $\alpha$-phase to $\gamma$-phase was determined by a metallographic test. The relationship between the elongation at rupture and the ratio $\gamma/(\alpha+\gamma)$ is shown in the form of a graph in FIG. 1.

Figure 1:
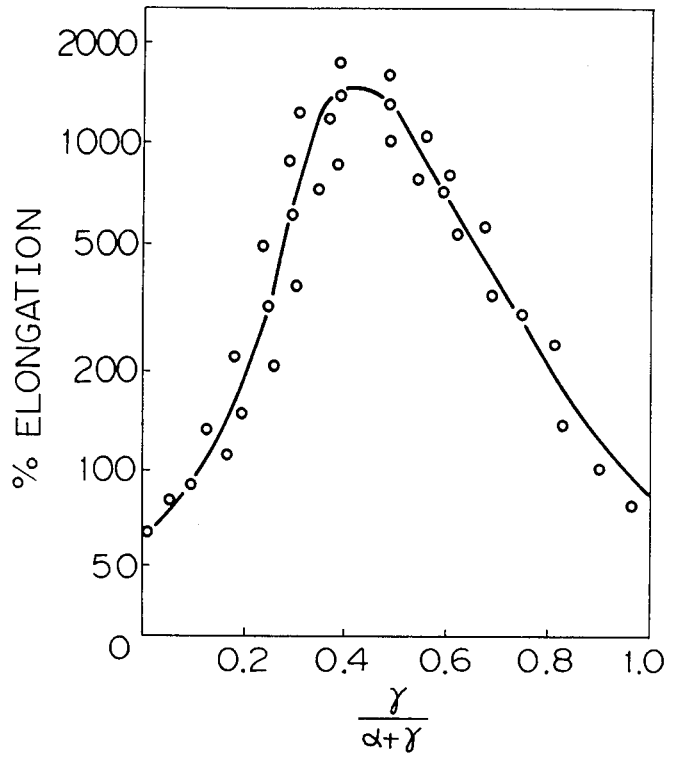
FIG. 1 is a graph showing the relationship between the ratio $\gamma/(\alpha+\gamma)$ and elongation.

From the results shown in FIG. 1, it can be seen that the closer to 1:1 is the ratio of $\alpha$-phase to $\gamma$-phase, the greater is the elongation that is obtained, and if at least about 20% of each is present simultaneously (i.e., the ratio $\gamma/(\alpha+\gamma)$ is in the range of 0.2–0.8), superplastic elongation of greater than 100% is obtained.

Next, the conditions which are necessary to obtain a ternary system which exhibits two phases consisting of $\alpha$-phase and $\gamma$-phase in the vicinity of 1000° C. and which as a value of $\gamma/\alpha+\gamma)$ in the range of 0.2–0.8 were found by metallographic tests of a total of 50 charges using the alloy compositions shown in Table 1 and by multiple regression analysis. In addition to Si, taking into consideration not only the ferrite-forming elements Cr and Mo but also the austenite-forming elements C, N, Ni, and Mn, it was found that the necessary conditions are defined by Si eq and Mn eq, as shown in FIG. 2, as satisfying the following formula:

$$(5/6)(\text{Si eq})-15/2 \leqq \text{Mn eq} \leqq (11/5)(\text{Si eq})-77/5.$$

The area between the two straight lines in FIG. 2 meets the conditions defined by the above formula. A preferable range is also shown in FIG. 2, which is $$1.1(\text{Si eq})-10.8 \leqq \text{Mn eq} \leqq 1.7(\text{Si eq})-14,$$

and $$\text{Si eq} = \text{from } 14 \text{ to } 26.$$

Such preferable range is indicated by the rhomboid in FIG. 2.

EXAMPLE 2

Duplex-phase stainless steels having the compositions shown in Table 3 below were prepared by a conventional method and then were formed into 12 mm-thick plates by blooming, forging, and hot rolling.

Using these plates, preliminary heat treatment and preliminary working were performed under the conditions shown in Table 4, after which hot tensile deformation was performed and elongation at rupture was measured.

From the results shown in Table 2 and Table 4, it can be seen that according to the method of the present invention, even though each duplex-phase ferrous alloy or stainless steel was deformed at a high strain rate, extremely good elongation of at least 100% was exhibited, and under these conditions, larger deformations are easily obtainable.

In contrast, in the comparative runs in these Tables which are indicated by the asterisk marks and in which either the alloy composition or the hot deforming conditions fell outside of the range of the present invention, it is clear that in none of these runs a high value of elongation of at least 100% was exhibited.

As explained above, according to the present invention, even when employing an inexpensive duplex-phase ferrous alloy, satisfactory superplastic working is possible at a relatively high strain rate, as a result of which its field of application is broadened. In addition, it is conceivable that such a duplex-phase ferrous alloy can be used in fields in which expensive duplex-phase stainless steels were conventionally used, such as production of plate heat exchangers, and its industrial benefits are therefore very substantial.

In the case of duplex-phase stainless steels, by employing the method of the present invention, improved superplasticity at a high strain rate can be attained constantly.

Due to the high strain rate, according to the present invention, it is generally not necessary to perform superplastic hot working while heating the ferrous alloy or stainless steel during deformation.

Although the present invention has been described with respect to preferred embodiments, it should be understood that various modifications may be employed without departing from the concept of the present invention which is defined by the appended claims.

TABLE 1

(% by weight)

| Steel Type | C | Si | Mn | P | S | Ni | Cr | Mo | N | Cu | Ti | Nb | Ca | Ce | Si eq* | Mn eq** | Remarks |
|---|---|---|---|---|---|---|---|---|---|---|---|---|---|---|---|---|---|
| A | 0.02 | 7.0 | 7 | 0.015 | 0.001 | 2.5 | 12 | 2 | 0.02 | | | | | 0.003 | 16.2 | 12.2 | This invention |
| B | 0.01 | 9.44 | 10 | 0.016 | 0.002 | 3 | 10 | 6 | 0.15 | | | | | | 20.0 | 19.1 | |
| C | 0.03 | 13.54 | 10 | 0.017 | 0.001 | 4 | 12 | 4 | 0.05 | | | | | | 24.1 | 22.3 | |
| D | 0.02 | 12 | 8 | 0.014 | 0.003 | 1 | 13 | 2 | 0.10 | | | | | | 24 | 16.2 | |
| E | 0.03 | 12 | 10 | 0.019 | 0.001 | 1 | 13 | 2 | 0.12 | 0.50 | 0.05 | | 0.002 | | 24 | 19.8 | |
| F | 0.01 | 12 | 10 | 0.020 | 0.002 | 2 | 13 | 2 | 0.11 | | | 0.10 | | | 24 | 20 | |
| G | 0.02 | 4 | 6 | 0.021 | 0.002 | 2.1 | 8 | 1 | 0.10 | | | | | | 10 | 10.2 | Comparative |
| H | 0.02 | 10 | 10 | 0.015 | 0.001 | 10.6 | 10 | 5 | 0.10 | | | | | | 20 | 31.2 | |
| I | 0.02 | 10 | 5.8 | 0.017 | 0.002 | 2.1 | 12 | 10 | 0.10 | | | | | | 26.4 | 10 | |

(Notes)
*Si eq = Si + $\frac{2}{3}$ (Cr + Mo)
**Mn eq = Mn + 2Ni + 60C + 50N
The balance is Fe and incidental impurities.

TABLE 2

| Run No. | Steel type | Hot deforming conditions: Heating temp. (°C.) | Hot deforming conditions: Strain rate ($S^{-1}$) | Hot tensile properties: Maximum stress ($kgf/mm^2$) | Hot tensile properties: Elongation (%) | Remarks |
|---|---|---|---|---|---|---|
| 1 | A | 1000 | $10^{-3}$ | 1.5 | 250 | This invention |
| 2 | B | 1100 | $10^{-3}$ | 1.0 | 600 | |
| 3 | B | 900 | $10^{-3}$ | 2.8 | 540 | |
| 4 | B | 1000 | $0.5 \times 10^{0}$ | 10 | 115 | |
| 5 | C | 1000 | $10^{-2}$ | 5 | 350 | |
| 6 | C | 750 | $10^{-5}$ | 9 | 215 | |
| 7 | D | 1000 | $10^{-3}$ | 1.7 | 450 | |
| 8 | E | 1000 | $10^{-3}$ | 1.8 | 380 | |
| 9 | F | 1000 | $10^{-3}$ | 1.5 | 280 | |
| 10* | B | 1000 | $10^{1}$** | 20 | 65 | Comparative |
| 11* | B | 1250** | $10^{-3}$ | 1.2 | 78 | |
| 12* | G* | 1000 | $10^{-3}$ | 2.0 | 35 | |
| 13* | H* | 1000 | $10^{-3}$ | 3.0 | 40 | |
| 14* | I* | 1000 | $10^{-3}$ | 1.5 | 75 | |

(Note)
*indicates comparative runs.
**indicates conditions outside the range of this invention

TABLE 3

| Steel type | Chemical Composition (% by weight): C | Si | Mn | p | S | Cu | Ni | Cr | Mo | O | N | Others* | Si eq** | Mn eq*** | Temp. at which single α-phase is formed (°C.) |
|---|---|---|---|---|---|---|---|---|---|---|---|---|---|---|---|
| A | 0.018 | 0.35 | 0.81 | 0.015 | 0.0006 | 0.12 | 7.03 | 25.32 | 2.92 | 0.002 | 0.123 | 0.30 W | 19.18 | 22.1 | 1320 |
| B | 0.015 | 0.55 | 1.82 | 0.014 | 0.0008 | 0.05 | 5.67 | 22.25 | 2.85 | 0.003 | 0.148 | — | 17.28 | 21.46 | 1270 |
| C | 0.020 | 1.18 | 0.89 | 0.015 | 0.0003 | 0.51 | 5.02 | 18.49 | 2.69 | 0.001 | 0.008 | 0.82 V | 15.3 | 12.53 | 1250 |
| D | 0.017 | 1.00 | 0.98 | 0.016 | 0.0002 | 0.35 | 9.82 | 28.03 | 2.43 | 0.003 | 0.015 | 0.31 Nb | 21.31 | 22.39 | 1330 |
| E | 0.018 | 3.0 | 5.0 | 0.02 | 0.0004 | 0.50 | 4.02 | 18.21 | — | 0.001 | 0.055 | — | 15.14 | 16.87 | 1280 |

(Notes)
*The balance is Fe and incidental impurities.
**Si eq = Si + $\frac{2}{3}$ (Cr + Mo)
***Mn eq = Mn + 2Ni + 60C + 50N

TABLE 4

| Run No. | Steel type | Preliminary heat treatment conditions: Heating temp. (°C.) | Preliminary heat treatment conditions: Cooling cond.*** | Conditions for preliminary working (RT: room temp.) | Hot deforming conditions: Atmosphere | Hot deforming conditions: Dew point (°C.) | Hot deforming conditions: Temp. (°C.) | Hot deforming conditions: Strain rate ($S^{-1}$) | Hot tensile properties: Elongation (%) |
|---|---|---|---|---|---|---|---|---|---|
| 1 | A | 1350 | W.Q. | 30% cold working/RT | Air | −35 | 950 | $2 \times 10^{-3}$ | 420 |
| 2 | | 1350 | W.Q. | 30% cold working/RT | $H_2$ | −35 | 950 | $2 \times 10^{-3}$ | 220 |
| 3 | | 1350 | W.Q. | 30% cold working/RT | Ar | −35 | 950 | $2 \times 10^{-3}$ | 330 |
| 4 | | 1350 | W.Q. | 30% cold working/RT | He | −35 | 950 | $2 \times 10^{-3}$ | 260 |
| 5 | | 1350 | W.Q. | 30% cold working/RT | 75% $H_2$ + 25% $N_2$ | −35 | 950 | $2 \times 10^{-3}$ | 425 |
| 6 | | 1350 | W.Q. | 30% cold working/RT | 2% $O_2$ + 98% $N_2$ | −35 | 950 | $2 \times 10^{-3}$ | 690 |
| 7 | | 1350 | W.Q. | 30% cold working/RT | $N_2$ | −35 | 950 | $2 \times 10^{-3}$ | 780 |
| 8 | | 1350 | W.Q. | 30% cold working/RT | $N_2$ | −40 | 950 | $2 \times 10^{-3}$ | 710 |
| 9 | | 1350 | W.Q. | 30% cold working/RT | $N_2$ | 0 | 950 | $2 \times 10^{-3}$ | 715 |
| 10 | | 1350 | W.Q. | 30% cold working/RT | $N_2$ | −10 | 950 | $2 \times 10^{-3}$ | 730 |
| 11 | | 1350 | W.Q. | 30% cold working/RT | $N_2$ | −50 | 950 | $2 \times 10^{-3}$ | 790 |
| 12* | B | 1300 | W.Q. | 50% cold working/RT | $N_2$ | −35 | 650** | $2 \times 10^{-3}$ | 70 |
| 13 | | 1300 | W.Q. | 50% cold working/RT | $N_2$ | −35 | 950 | $2 \times 10^{-3}$ | 480 |
| 14* | | 1300 | W.Q. | 50% cold working/RT | $N_2$ | −35 | 950 | $5 \times 10^{1}$** | 65 |
| 15 | C | 1250 | W.S.C. | None | $N_2$ | −35 | 950 | $2 \times 10^{-3}$ | 630 |
| 16 | D | 1350 | W.Q. | 30% cold working/RT | $N_2$ | −35 | 950 | $2 \times 10^{-3}$ | 730 |

TABLE 4-continued

| Run No. | Steel type | Preliminary heat treatment conditions: Heating temp. (°C.) | Preliminary heat treatment conditions: Cooling cond.*** | Conditions for preliminary working (RT: room temp.) | Hot deforming conditions: Atmosphere | Hot deforming conditions: Dew point (°C.) | Hot deforming conditions: Temp. (°C.) | Hot deforming conditions: Strain rate ($S^{-1}$) | Hot tensile properties: Elongation (%) |
|---|---|---|---|---|---|---|---|---|---|
| 17 | E | 1200 | W.Q. | None | $N_2$ | −35 | 950 | $4 \times 10^{-3}$ | 450 |
| 18 | | 1200 | W.Q. | 50% cold working/RT | $N_2$ | −35 | 950 | $4 \times 10^{-3}$ | 850 |

(Note)
*indicates comparative runs.
**indicates conditions outside the range of this invention.
***Cooling conditions: W.Q. = water quenching; W.S.C. = water spray cooling.

What is claimed is:

1. A superplastic duplex-phase ferrous alloy which exhibits an $(\alpha+\gamma)$ duplex-phase structure at temperatures in the range of 700°-1200° C., and which consists essentially of, by weight, at least one of Si and Mn in an amount of not less than 0.5% and not less than 1.7%, respectively, and not more than 20.0 and 30.0%, respectively,

| | |
|---|---|
| N: at least 0.01% and up to 0.3% in solid solution, | |
| Ni: 0-5.0%, | Cr: 0-20.0%, |
| Mo: 0-6.0%, | Cu: 0-1.0%, |
| Ti: 0-0.5%, | Zr: 0-0.5%, |
| Nb: 0-0.5%, | V: 0-0.5%, |
| W: 0-1.0%, | |

the balance being Fe and incidental impurities including C in an amount of from 0-0.5%, wherein Si eq and Mn eq which are defined as $$Si\ eq = Si + (\tfrac{2}{3})(Cr+Mo),$$

and $$Mn\ eq = Mn + 2Ni + 60C + 50N$$

satisfy the formula $$(5/6)(\text{Si eq}) - 15/2 \leqq \text{Mn eq} \leqq (11/5)(\text{Si eq}) - 77/5.$$

2. A superplastic duplex-phase ferrous alloy as defined in claim 1 wherein Si eq and Mn eq satisfy the following formulas:

$$1.1(\text{Si eq}) - 10.8 \leqq \text{Mn eq} \leqq 1.7(\text{Si eq}) - 14,$$

and

Si eq=from 14 to 26.

3. A superplastic duplex-phase ferrous alloy as defined in claim 1 which contains 0.05-0.25% by weight of N in solid solution.

4. A superplastic duplex-phase ferrous alloy which exhibits an $(\alpha+\gamma)$ duplex-phase structure at temperatures in the range of 700°-1200° C., and which consists essentially of, by weight,

| | |
|---|---|
| Si: 0.1-20.0%, | Mn: 0.1-30.0%, |
| N: 0.05-0.25% in solid solution, | |
| Ni: 0.05-4.0%, | Cr: 5.0-15.0%, |
| Mo: 0.05-4.0%, | Cu: 0-0.6%, |
| Ti: 0-0.3%, | Zr: 0-0.3%, |
| Nb: 0-0.3%, | V: 0-0.3%, and |
| W: 0-0.6%, | |

the balance being Fe and incidental impurities including C in an amount of from 0-0.5%, wherein at least one of Si and Mn is in an amount of not less than 0.5% for Si and not less than 1.7% for Mn, and Si eq and Mn eq which are defined as $$Si\ eq = Si + (2/3)(Cr+Mo),$$

and $$Mn\ eq = Mn + 2Ni + 60C + 50N$$

satisfy the formulas $$1.1(\text{Si eq}) - 10.8 \leqq \text{Mn eq} \leqq 1.7(\text{Si eq}) - 14,$$

and

*Si eq=from* 14 to 26.

5. A superplastic duplex-phase ferrous alloy as defined in claim 4 wherein the amount of Si, Mn, Ni, Cr, and Mo are as follows:

| | |
|---|---|
| Si: 0.5-15.0%, | Mn: 1.5-20.0%, |
| Ni: 1.0-4.0%, | Cr: 10.0-15.0%, |
| Mo: 1.0-4.0%. | |

6. An article made of a superplastic duplex-phase ferrous alloy which exhibits an $(\alpha+\gamma)$ duplex-phase structure at temperatures in the range of 700°-1200° C., and which consists essentially of, by weight, at least one of Si and Mn in an amount of not less not 0.5% and not less than 1.7%, respectively, and not more than 20.0 and 30.0% respectively,

| | |
|---|---|
| N: at least 0.01% and up to 0.3% in solid solution, | |
| Ni: 0-5.0%, | Cr: 0-20.0%, |
| Mo: 0-6.0%, | Cu: 0-1.0%, |
| Ti: 0-0.5%, | Zr: 0-0.5%, |
| Nb: 0-0.5%, | V: 0-0.5%, |
| W: 0-1.0%, | |

the balance being Fe and incidental impurites including C in an amount of from 0-0.5%, wherein Si eq and Mn eq which are defined as $$Si\ eq = Si + (2/3)(Cr+Mo),$$

and $$Mn\ eq = Mn + 2Ni + 60C + 50N$$

satisfy the formula $$(5/6)(\text{Si eq}) - 15/2 \leqq \text{Mn eq} \leqq (11/5)(\text{Si eq}) - 77/5.$$

7. An article made of the superplastic duplex-phase ferrous alloy defined in claim 6 wherein Si eq and Mn eq satisfy the following formulas:

$$1.1(\text{Si eq}) - 10.8 \leqq \text{Mn eq} \leqq 1.7(\text{Si eq}) - 14,$$

and $Si\ eq$=from 14 to 26.

8. An article made of the superplastic duplex-phase ferrous alloy defined in claim 6 which contains 0.05–0.25% by weight of N in solid solution.

9. An article made of a superplastic duplex-phase ferrous alloy which exhibits an $(\alpha+\gamma)$ duplex-phase structure at temperatures in the range of 700°–1200° C., and which consists essentially of, by weight,

| | |
|---|---|
| Si: 0.1–20.0%, | Mn: 0.1–30.0%, |
| N: 0.05–0.25% in solid solution, | |
| Ni: 0.05–4.0%, | Cr: 5.0–15.0%, |
| Mo: 0.05–4.0%, | Cu: 0–0.6%, |
| Ti: 0–0.3%, | Zr: 0–0/3%, |
| Nb: 0–0.3%, | V: 0–0/3%, and |
| W: 0–0.6%, | |

the balance being Fe and incidental impurities including C in an amount of from 0–0.5%, wherein at least one of Si and Mn is in an amount of not less than 0.5% for Si and not less than 1.7% for Mn, and Si eq and Mn eq which are defined as $$Si\ eq = Si + (\tfrac{2}{3})(Cr + Mo),$$

and $$Mn\ eq = Mn + 2Ni + 60C + 50N$$

satisfy the formulas $$1.1(\text{Si eq}) - 10.8 \leqq \text{Mn eq} \leqq 1.7(\text{Si eq}) - 14,$$

and $Si\ eq$=*from* 14 to 26.

10. An article made of the superplastic duplex-phase ferrous alloy defined in claim 9 wherein in the amount of Si, Mn, Ni, Cr, and Mo are as follows:

| | |
|---|---|
| Si: 0.5–15.0%, | Mn: 1.5–20.0%, |
| Ni: 1.0–4.0%, | Cr: 10.0–15.0%, |
| Mo: 1.0–4.0%. | |

* * * * *